United States Patent [19]

DeFilippis

[11] 4,198,616

[45] Apr. 15, 1980

[54] BIMETALLIC THERMOSTATS WITH SEVERAL RESPONSE TEMPERATURES

[75] Inventor: Giangrazio DeFilippis, Naples, Italy

[73] Assignee: Texas Instruments Incorporated, Dallas, Tex.

[21] Appl. No.: 879,327

[22] Filed: Feb. 21, 1978

[51] Int. Cl.[2] ..... H01H 37/52

[52] U.S. Cl. ..... 337/371; 337/86; 337/96; 337/336; 337/337

[58] Field of Search ..... 337/371, 370, 335–338, 337/340, 363, 85, 86, 95, 96

[56] References Cited

U.S. PATENT DOCUMENTS

| | | | |
|---|---|---|---|
| 3,582,853 | 6/1971 | Morris | 337/370 X |
| 3,713,062 | 1/1973 | Butler et al. | 337/337 X |
| 3,852,695 | 12/1974 | Northrup | 337/336 X |

*Primary Examiner*—R. L. Moses

*Attorney, Agent, or Firm*—John A. Haug; James P. McAndrews

[57] ABSTRACT

The present invention relates to an improvement in bimetallic thermostatic switches having several temperatures of response.

3 Claims, 15 Drawing Figures

BIMETALLIC THERMOSTATS WITH SEVERAL RESPONSE TEMPERATURES

Bimetallic thermostats with several temperatures of response are known. These conventional designs, however, are usually limited to two temperatures of response and comprise a pair of calotte-shaped or dish-shaped disk elements coaxially disposed to mechanically actuate electrical contacts at the predetermined snap-over temperatures which cause reversal of the curvatures of the calotte-shaped thermosensitive elements.

These known devices require a mechanical construction of a high degree of precision and are considerably expensive and bulky in space.

It is an object of the present invention to provide a thermostat having several temperatures of response which is of simple, compact and economical construction and which incorporates sensors having more than two temperatures of response in a single unit.

The present invention will be described with reference to two forms of realization of temperature sensor or thermostatic switch, one with "normally open" contacts and one with "normally closed" contacts. By way of example, the two forms of realization will be described with reference to devices having three temperatures of response; but, as will become clear from the further description of the present invention, the system is adapted to provide temperature sensing with any selected number of response temperatures.

The present invention will now be described with reference to its two presently preferred forms of realization which are given for purposes of illustration only, the description referring to the attached drawings wherein.

Figure 1:
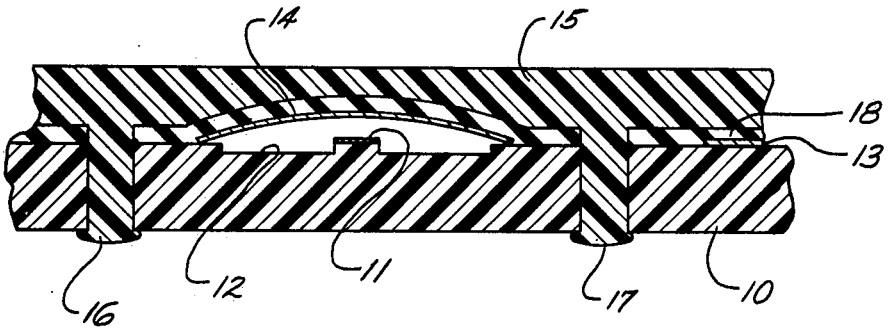
FIG. 1 is a partial section view to enlarged scale along a principal axis of the switching means in a preferred embodiment of this invention.

With reference to FIG. 1, the basic sensing and switching means of the "normally open" configuration of a first embodiment of this invention is shown to comprise a base 10 on which in known manner a first metallic track 11 is made on a protuberance placed substantially at the center of the circular seat 12, and a second metallic track 13 is likewise made in known manner on the base 10. The metallic tracks 11 and 13 form part of two branches of a circuit which is to be closed by the actuation of the calotte-shaped or dish-shaped bimetallic element 14 of known design. The calotte-shaped bimetallic element 14 is held in position by the covering element 15 which is joined to the base 10 with the hot or ultrasonically riveted pins 16 and 17.

Between the elements 10 and 15, a layer of electrically conductive elastomer 18 is disposed which forms an elastic, flexible continuous contact between track 13 and the periphery or upper surface of the calotte-shaped element 14. When the calotte-shaped element reverses its curvature at a predetermined snap-over temperature in conventional manner, the circuit between track 13 and track 11 is closed. The temperatures of response of different disks in the device are selected in accordance with the particular calotte-shaped elements 14 which are used.

Figure 2:
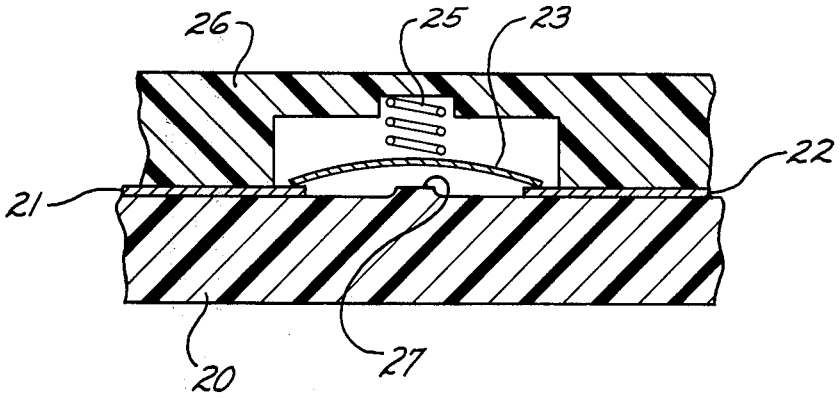
FIG. 2 is a partial section view similar to FIG. 1 illustrating the switching means in another preferred embodiment of this invention.
Figure 3:
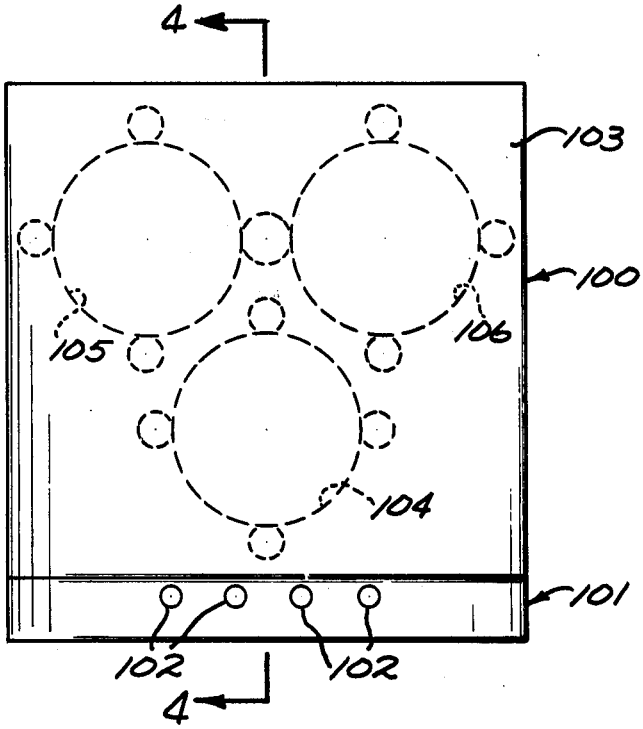
FIG. 3, is a plan view of a preferred embodiment of this invention incorporating the switching means illustrated in FIG. 1.

In the form of realization of the sensing and switching means having a "normally closed contact" configuration of another preferred embodiment of this invention as shown in FIG. 2, a base 20 is provided on which two conducting tracks 21 and 22 are made to form two separate parts of a circuit normally kept closed by the calotte-shaped bimetallic disk 23 which is held against the said conductive tracks by a spring 24 housed in seat 25 of the upper insulating base 26. Under these circumstances as shown in FIG. 2, the circuit is closed between the tracks 21 and 22. At the temperature of response, the calotte-shaped, bimetallic disk 23 reverses its curvature and bears against the rod or protuberance 27, thus interrupting the circuit between the tracks 21 and 22.

Two forms of realization of thermostatic switching devices of this invention each having three temperatures of response will now be described with respect to the sets of FIGS. 3 through 9 and 10 through 15.

Figure 4:
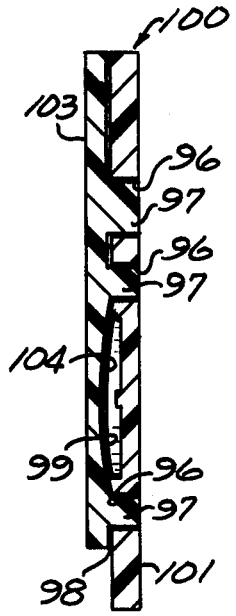
FIG. 4 is a section view along line 4—4 of FIG. 3.
Figure 8:
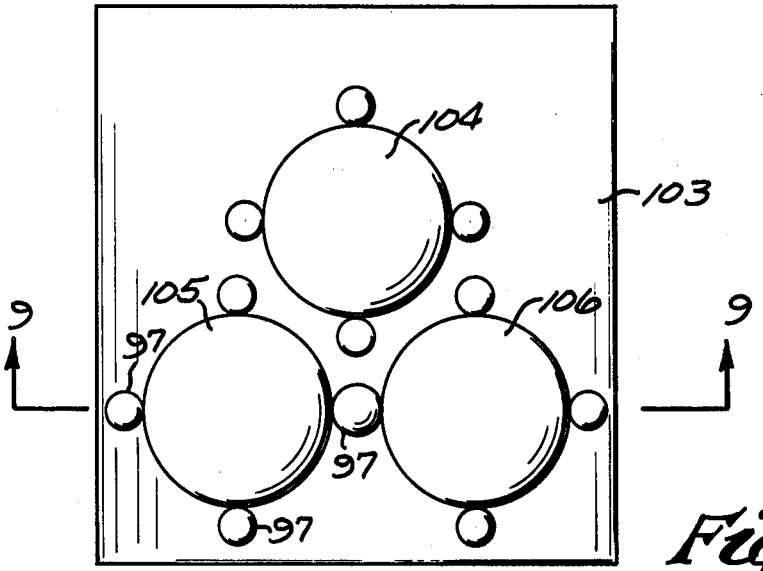
FIG. 8 is a bottom view of the component of the device of FIG. 3 which has been removed in the illustration of FIG. 5.
Figure 9:
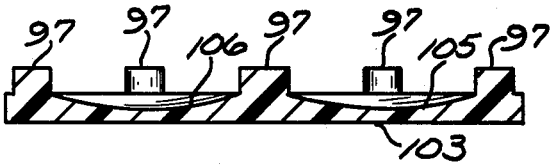
FIG. 9 is a section view along line 9—9 of FIG. 8.

In the set of FIGS. 3 through 9, FIG. 3 shows a sensing unit designated as a whole as 100 which has three temperatures of response and which utilizes sensing and switching means corresponding to those shown in FIG. 1. The unit 100 comprises a lower base 101 on which are disposed four terminals 102, one comprising a "common" and three comprising "active" terminals. See FIG. 5. An upper base or lid 103 is fastened on the lower base 101, the upper base having recesses or housings 104, 105, and 106 (best seen in FIGS. 8 and 9) for receiving calotte-shaped bimetallic disks 99. Each of the discs 99, which are not shown in FIG. 3 but which are illustrated in FIG. 4, has a predetermined temperature of response at which it is adapted to undergo a reversal of its direction of curvature, each of the three disks 99 used in the device 101 being adapted to reverse its curvature at a different temperature as will be understood. A layer of conducting rubber, not seen in FIG. 3 but shown at 98 in FIG. 4 corresponds in shape to the upper base 103 and is disposed between the bases 101 and 103 to bear on the plane part of upper base 103 and on the concave surfaces of the housings or recesses 104, 105 and 106 to engage the normally convex side of the bimetallic disks 99 housed in the recesses 104, 105 and 106.

Figure 5:
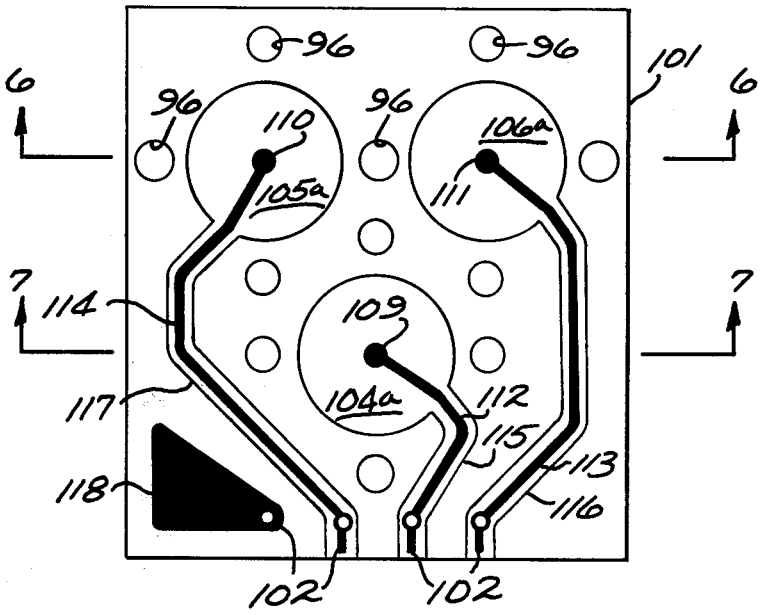
FIG. 5 is a plan view of the embodiment of the invention shown in FIG. 3 illustrating the device of FIG. 3 with its upper components removed.
Figure 6:
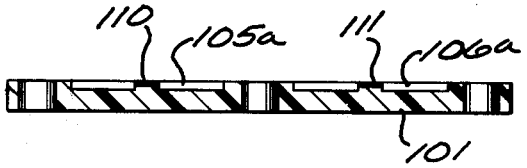
FIG. 6 is a section view along line 6—6 of FIG. 5.
Figure 7:
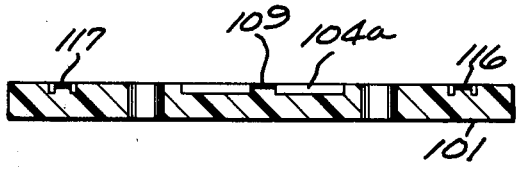
FIG. 7 is a section view along line 7—7 of FIG. 5.

Referring to FIGS. 5, 6 and 7, the lower base 101 will now be described. The said base 101 contains recesses 104*a*, 105*a* and 106*a* of a diameter slightly smaller than that of the bimetallic disks 99, each of these recesses having a protuberance 109, 110 or 111 at its center. The protuberances 109, 110 and 111 are each electrically connected with a conducting track 112, 113 or 114 which pass in grooves 115, 116 or 117 in the base 101 and which terminate on connection to respective terminals 102.

One of the terminals 102 is connected to a conducting plate or layer 118 on the base 101 which makes contact with the layer of conducting rubber 98 disposed between the two bases 101 and 103. Plate 118 thus constitutes a "common" connection to the disks 99.

When in operation, if the unit 100 is below the temperature of response of any of the disks 99, all the contacts or switches of the unit 101 are open. However, when the unit 101 is heated so that the snap-over temperatures of the respective bimetallic disks 99 are reached in sequence, the latter make contact between the conductive rubber 98 and respective protuberances 109, 110 and 111, thereby sequentially closing respective circuits between the "common" terminal 102 connected to the plate 118 and respective ones of the "active" terminals 102.

FIGS. 3 through 9 thus show a unit which is able to respond to three temperatures. However, a person skilled in the art will readily understand that the unit can be easily modified to respond to any number of different temperatures.

FIGS. 10 through 15 show a second preferred embodiment of the device according to this invention which has three temperatures of response and which utilizes sensing and switching means corresponding to those shown in FIG. 2.

Figure 10:
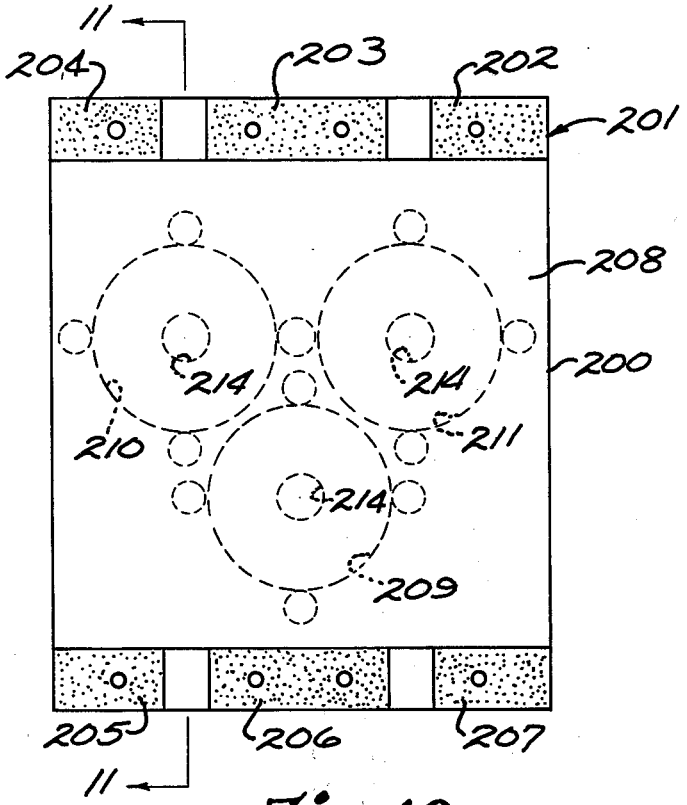
FIG. 10 is a plan view of another preferred embodiment of this invention incorporating the switching means of FIG. 2.
Figure 11:
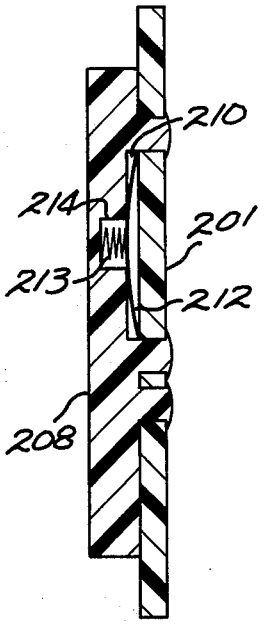
FIG. 11 is a section view along line 11—11 of FIG. 10.
Figure 14:
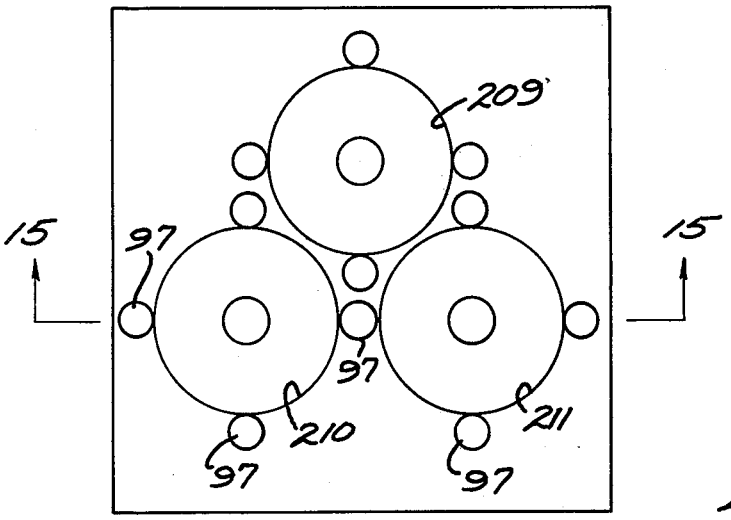
FIG. 14 is a bottom view of the component of the device of FIG. 3 which has been removed in the illustration of FIG. 12.
Figure 15:
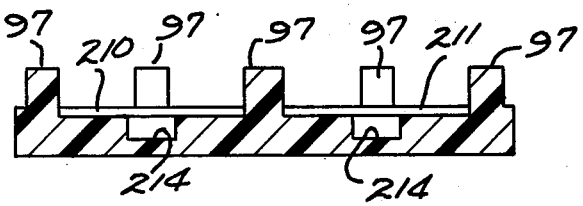
FIG. 15 is a section view along line 15—15 of FIG. 14.

Referring to FIGS. 10 to 15, another preferred device according to this invention is shown as a unit in FIG. 10 and designated as a whole as 200. The said unit comprises a lower base 201 carrying the contact zones 202, 203, 204, 205, 206 and 207, as will be further illustrated below, and an upper base 208. In the upper base 208 as shown in FIGS. 14 and 15, there are housings or recesses 209, 210 and 211 in which the bimetallic disks 212 are housed and are pressed against the lower bse 201 by means of springs 213 housed in wells 214 inside the recesses 209, 210 and 211.

Figure 12:
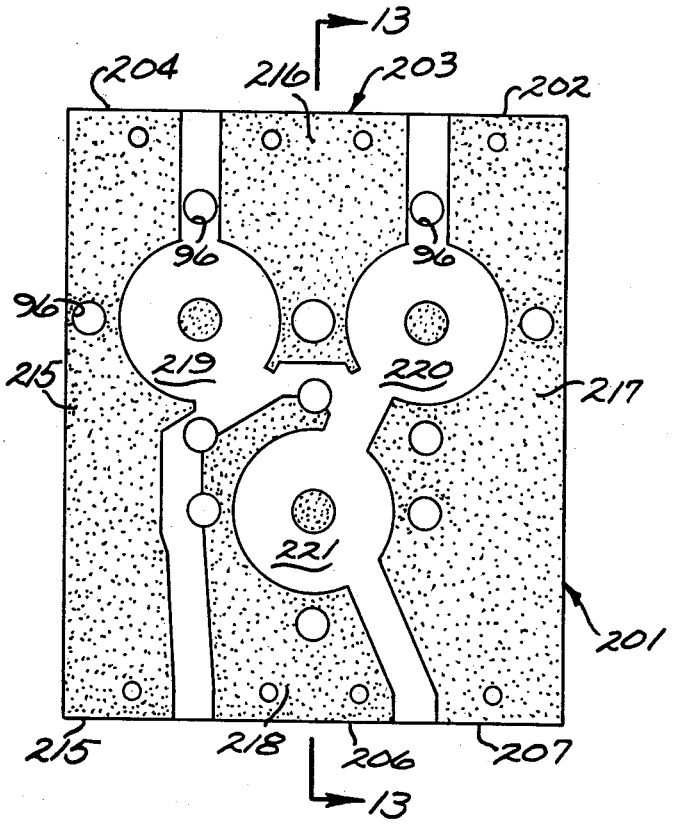
FIG. 12 is a plan view of the embodiment of this invention shown in FIG. 10 illustrating the device of FIG. 10 with its upper components removed.
Figure 13:
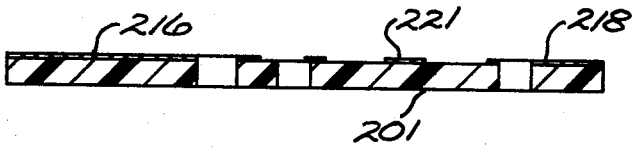
FIG. 13 is a section view along line 13—13 of FIG. 12.

On the lower plate 201 of insulating material as best seen in FIGS. 12 and 13, electrically separated conducting zones 215, 216 217 and 218 are disposed in known manner and are connected to the terminals 202, 203, 204, 205, 206 and 207 as shown in FIG. 12. When the disks 212 in the device 200 are not activated, the edges of the bimetallic disks engage and short-circuit the inner peripheral zones of track 215 to 216, of track 216 to 217, and of track 217 to 218. However, as the disks 212 reverse curvature to bear against protuberances in the centers of recesses 219, 220 and 221 on the base 201 under the pressure of springs 213 (FIG. 11) circuits are opened between the tracks 218 and 217, between tracks 215 and 216, and between the tracks 216 and 217 respectively.

As can be seen from FIGS. 3 through 15 describing various embodiments of the invention, the lower bases of the units 100 and 200 contain shaped holes 96 which cooperate to engage pins 97 disposed on the upper bases to serve the double purpose of effecting the centering of the bimetallic disk elements and the joining of two bases with each other during assembly of the devices when the ends of the pins protruding from the holes in the lower base are hot or ultrasonically riveted.

The present invention has been described by reference to two preferred forms of realization which are given by way example only and without limiting the scope of the invention in any way whatsoever. It is understood that variations or modifications of the said forms can be made by one skilled in the art without departing from the scope of the present invention.

I claim:

1. A compact, low cost multitemperature thermostatic switch device comprising a first relatively thin, sheet-like base member of a dielectric material having a plurality of at least three pairs of contact means fixedly disposed thereon in a generally common plane, a plurality of bimetallic elements of original dish-shaped curvatures which are each adapted to reverse their curvature when heated to respective different response temperatures, said bimetallic elements being disposed on the first base member generally is said common plane so that the elements engage and span respective pairs of the contact means to electrically connect the contacts of the respective pairs when the elements are disposed in one of said curvatures and so that the elements disengage and open connection between said respective pairs of contact means when the elements are disposed in the other of said curvatures, a second relatively thin, sheet-like base member of a dielectric material secured to the first base member in a plane over the first member, resilient means disposed between the base members to engage the bimetallic elements for movably mounting the bimetallic elements to permit movement of selected ones of the elements between said curvatures in response to the occurrence of selected different temperature changes in a temperature zone to be monitored, and terminals means connected to the respective contact means.

2. A multitemperature thermostatic switch device as set forth in claim 1 wherein said first base member has a plurality of first contacts plated thereon, the second contact in each of said pairs is formed by a common additional contact means, a said resilient means comprises a flexible electrically conductive organic member disposed in overlying engagement with said bimetallic elements and in engagement with said common second contact, said second base member holding the flexible member in electrical engagement with said bimetallic elements.

3. A multitemperature thermostatic switch device as set forth in claim 1 wherein said bimetallic elements are disposed on the first base member for interconnecting respective pairs of the contact means when the elements are disposed in said original curvatures and for reacting against said first base member for opening connection between said respective pairs of contact means when the elements reverse their curvatures.

* * * * *